US009931852B2

(12) United States Patent
Tsukahara et al.

(10) Patent No.: US 9,931,852 B2
(45) Date of Patent: Apr. 3, 2018

(54) LIQUID SUPPLY APPARATUS, LIQUID CONTAINER

(71) Applicant: SEIKO EPSON CORPORATION, Tokyo (JP)

(72) Inventors: Katsutomo Tsukahara, Matsumoto (JP); Hiroyuki Kawate, Hokuto (JP); Yoshiyuki Tanaka, Matsumoto (JP); Tokujiro Okuno, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 14/295,481

(22) Filed: Jun. 4, 2014

(65) Prior Publication Data

US 2014/0360596 A1 Dec. 11, 2014

(30) Foreign Application Priority Data

Jun. 6, 2013 (JP) ..... 2013-119571

(51) Int. Cl.
*B41J 2/175* (2006.01)
*B65D 30/00* (2006.01)
*B65D 33/06* (2006.01)

(52) U.S. Cl.
CPC ..... *B41J 2/17513* (2013.01); *B41J 2/1752* (2013.01); *B41J 2/17509* (2013.01); *B41J 2/17523* (2013.01); *B65D 31/00* (2013.01); *B65D 33/06* (2013.01); *B41J 2002/17516* (2013.01); *Y10T 137/7039* (2015.04)

(58) Field of Classification Search
CPC .... B41J 2/17513; B41J 2/17553; B41J 2/175; B41J 2002/17516
See application file for complete search history.

(56) References Cited

U.S. PATENT DOCUMENTS

| | | | | |
|---|---|---|---|---|
| 5,860,363 | A | 1/1999 | Childers et al. | |
| 6,203,147 | B1 | 3/2001 | Battey et al. | |
| 6,375,315 | B1 | 4/2002 | Steinmetz et al. | |
| 6,416,166 | B1 | 7/2002 | Robinson et al. | |
| 7,891,789 | B2 | 2/2011 | Hibbard et al. | |
| 2002/0171713 | A1 * | 11/2002 | Ueno | B41J 2/17509 347/49 |

(Continued)

FOREIGN PATENT DOCUMENTS

| | | | |
|---|---|---|---|
| EP | 2 653 313 | A2 | 10/2013 |
| JP | 59-212272 | A | 12/1984 |

(Continued)

*Primary Examiner* — Jason Uhlenhake
(74) *Attorney, Agent, or Firm* — Foley & Lardner LLP

(57) ABSTRACT

A liquid supply apparatus is configured to have detachably installed therein a liquid container 51 including an ink bag 82 that is flexible at least in part and a flow channel member 91 that is in communication with the ink bag 82, and to supply a liquid held in the ink bag 82 to a liquid jet apparatus. The liquid supply apparatus includes an ink inlet portion 143 configured to be connected to the flow channel member 91 and to introduce liquid from the flow channel member 91 in a state where the flow channel member 91 is connected, and a first supporting portion 151 configured to support at least the flow channel member 91 of the ink container 51. The first supporting portion 151 is moveable between at least a connected position and a disconnected position of the flow channel member 91 and the ink inlet portion 143.

18 Claims, 15 Drawing Sheets

(56) References Cited

U.S. PATENT DOCUMENTS

| | | | | |
|---|---|---|---|---|
| 2003/0043243 | A1* | 3/2003 | Trafton | B41J 2/17513 347/86 |
| 2003/0222940 | A1 | 12/2003 | Seino et al. | |
| 2004/0063145 | A1 | 4/2004 | Jones | |
| 2005/0001888 | A1 | 1/2005 | Seino et al. | |
| 2005/0062811 | A1* | 3/2005 | Ishizawa | B41J 2/17513 347/86 |
| 2007/0206076 | A1 | 9/2007 | Seino et al. | |
| 2009/0290001 | A1 | 11/2009 | Domae | |
| 2011/0254905 | A1* | 10/2011 | Hayashi | B41J 2/175 347/86 |
| 2011/0285798 | A1* | 11/2011 | Matsuo | B41J 2/17513 347/86 |
| 2013/0182051 | A1 | 7/2013 | Aoki et al. | |
| 2014/0362148 | A1* | 12/2014 | Ishizawa | B41J 2/17523 347/86 |

FOREIGN PATENT DOCUMENTS

| | | | |
|---|---|---|---|
| JP | 2002-120382 | A | 4/2002 |
| JP | 2004-168341 | A | 6/2004 |
| JP | 2006-069030 | A | 3/2006 |
| JP | 2007-090646 | A | 4/2007 |
| JP | 2009-172918 | A | 8/2009 |
| JP | 2009-202346 | A | 9/2009 |
| JP | 2009-279876 | A | 12/2009 |
| JP | 2010-058525 | A | 3/2010 |
| JP | 2012-116102 | A | 6/2012 |
| JP | 2012-116202 | A | 6/2012 |
| JP | 2012-158343 | A | 8/2012 |
| WO | 2014/034111 | A | 3/2014 |

* cited by examiner

LIQUID SUPPLY APPARATUS, LIQUID CONTAINER

BACKGROUND

1. Technical Field

The present invention relates to a liquid supply apparatus, a liquid container, and the like.

2. Related Art

Inkjet printers are a known type of liquid injection apparatus. Typically, Inkjet printers print on recording media such as paper by injecting ink onto the recording media from a recording head. In order to stably supply ink to the recording head of such printers, a configuration in which an external ink supply apparatus (liquid supply apparatus) is connected to the printer is known (see, for example, JP-A-2009-202346).

The external ink supply apparatus recited in JP-A-2009-202346 has an ink supply tube (exemplary liquid inlet portion) connected to a connection portion (exemplary liquid outlet portion) of an ink bag. Ink inside the ink bag is supplied to the printer from the connection portion via the ink supply tube. In the external ink supply apparatus, the connection portion to which the ink supply tube is connected is located on the lower side of the ink bag in the vertical direction. The connection portion of the ink bag is thus difficult to see when replacing the ink bag, for example. Thus, there is a problem with known liquid supply apparatuses in that it is difficult to attach and detach the liquid inlet portion to and from the liquid outlet portion.

SUMMARY

The invention may be realized as the following embodiments or application examples.

Application Example 1

According to an aspect of the invention, a liquid supply apparatus is configured to have detachably installed therein a liquid container including a liquid containing portion that is flexible at least in part and a liquid outlet portion that is in fluid communication with the liquid containing portion, and to supply a liquid held in the liquid containing portion to a liquid injection apparatus. The liquid supply apparatus includes a liquid inlet portion configured to be connected to the liquid outlet portion and to introduce the liquid from the liquid outlet portion in a state where the liquid outlet portion is connected, and a first supporting portion configured to support at least the liquid outlet portion of the liquid container. The first supporting portion is movable between at least a connected position of the liquid outlet portion and the liquid inlet portion and a disconnected position of the liquid outlet portion and the liquid inlet portion.

According to this liquid supply apparatus, attachment and detachment of the liquid outlet portion to and from the liquid inlet portion are facilitated, since the liquid container is movable between a connected position and a disconnected position with respect to the liquid inlet portion as a result of the liquid outlet portion being supported by the first supporting portion.

Application Example 2

It may be preferably that the liquid supply apparatus further includes an operation portion for moving the first supporting portion.

In this application example, attachment and detachment of the liquid outlet portion to and from the liquid inlet portion are further facilitated, since the first supporting portion can be moved between at least the connected position and the disconnected position by operating the operation portion.

Application Example 3

It may be preferably that, in the liquid supply apparatus, the liquid container has a handle portion that projects on an opposite side to the liquid containing portion side with respect to the liquid outlet portion.

With this application example, liquid is unlikely to leak out, since the liquid container can be held such that the liquid outlet portion is positioned higher up than the liquid containing portion by gripping the handle portion. Also, the provision of the handle portion facilitates carrying of the liquid container. Moreover, damaging the liquid containing portion due to holding a flexible portion thereof is easily avoided by holding the handle portion.

Application Example 4

It may be preferable that the liquid supply apparatus further includes a second supporting portion configured to support the handle portion of the liquid container, when the liquid outlet portion of the liquid container is connected to the liquid inlet portion.

With this application example, the handle portion is supported by the second supporting portion when the liquid outlet portion of the liquid container is connected to the liquid inlet portion, enabling the weight of the liquid containing portion to be taken by the second supporting portion via the handle portion. Accordingly, the load on the liquid outlet portion is suppressed.

Application Example 5

It may be preferable that, in the liquid supply apparatus, the handle portion and the liquid outlet portion are integrally formed.

With this application example, the handle portion and the liquid outlet portion are integrally formed, enabling the number of components to be reduced. The manufacturing processes can also be reduced.

Application Example 6

It may be preferable that, in the liquid supply apparatus, the handle portion has a connection portion connected to the liquid outlet portion and a gripping portion provided at a site that is projected on an opposite side to the liquid containing portion side with respect to the connection portion, and the gripping portion of the handle portion is thicker than the connection portion.

With this application example, the handle portion is easy to grip, because the gripping portion is thicker than the connection portion located nearer to the liquid containing portion side than the gripping portion.

Application Example 7

It may be preferable that, in the liquid supply apparatus, the liquid outlet portion includes an engaging portion configured to engage the first supporting portion.

With this application example, the provision of the engaging portion in the liquid outlet portion allows the liquid outlet portion to be easily attached to the liquid inlet portion by engaging the engaging portion with the first supporting portion.

Application Example 8

It may be preferable that, in the liquid supply apparatus, the liquid outlet portion is oriented in a direction intersecting the direction of gravity when supported by the first supporting portion.

With this application example, the liquid outlet portion is easy to see, enabling support by the first supporting portion to be reliably implemented. Thus, the liquid container is prevented from dropping down when the first supporting portion moves, and attachment and detachment of the liquid outlet portion to and from the liquid inlet portion can be performed with ease.

Application Example 9

According to a further aspect of the invention, a liquid container is configured to hold a liquid for supplying to a liquid jet apparatus. The liquid container includes a liquid containing portion that is flexible at least in part and configured to hold the liquid internally, a liquid outlet portion provided at an end portion of the liquid containing portion and configured to introduce the liquid of the liquid containing portion to outside of the liquid containing portion, and a handle portion that projects on an opposite side to the liquid container side with respect to the liquid outlet portion.

With this liquid container, liquid is unlikely to leak out from the liquid outlet portion, since the liquid container can be held such that the liquid outlet portion is positioned above the liquid containing portion by gripping the handle portion. Also, the provision of the handle portion facilitates carrying of the liquid container. Moreover, damaging the liquid containing portion due to holding a flexible portion thereof is easily avoided by holding the handle portion.

Application Example 10

It may be preferable that, in the liquid container, the handle portion and the liquid outlet portion are integrally formed.

With this application example, the handle portion and the liquid outlet portion are integrally formed, enabling the number of components to be reduced. The manufacturing processes can also be reduced.

Application Example 11

It may be preferable that, in the liquid container, the handle portion has a connection portion connected to the liquid outlet portion and a gripping portion provided at a site that is projected further on an opposite side to the liquid containing portion side than the connection portion, and the gripping portion of the handle portion is thicker than the connection portion.

With this application example, the handle portion is easy to grip, because the gripping portion is thicker than the connection portion located nearer to the liquid containing portion side than the gripping portion.

Application Example 12

According to a still further aspect of the invention, a liquid container is configured to be detachably installed in a liquid supply apparatus that supplies a liquid to a liquid jet apparatus. The liquid container includes a liquid containing portion that is flexible at least in part and configured to hold the liquid internally, and a liquid outlet portion provided at an end portion of the liquid containing portion and configured to introduce the liquid in the liquid containing portion to outside of the liquid containing portion. The liquid outlet portion includes an engaging portion configured to engage a first supporting portion provided in the liquid supply apparatus to be moveable between at least a connected position of the liquid outlet portion and the liquid inlet portion and a disconnected position of the liquid outlet portion and the liquid inlet portion.

With this application example, the provision of the engaging portion in the liquid outlet portion allows the liquid outlet portion to be easily attached to the liquid inlet portion by engaging the engaging portion with the first supporting portion.

Application Example 13

It may be preferable that the liquid container further includes a handle portion that projects on an opposite side to the liquid containing portion side with respect to the liquid outlet portion.

With this application example, liquid is unlikely to leak out, since the liquid container can be held such that the liquid outlet portion is positioned higher up than the liquid containing portion by gripping the handle portion. Also, the provision of the handle portion facilitates carrying of the liquid container. Moreover, damaging the liquid containing portion due to holding a flexible portion thereof is easily avoided by holding the handle portion.

Application Example 14

It may be preferable that, in the liquid container, the handle portion is supported by a second supporting portion provided in the liquid supply apparatus, when the liquid outlet portion is connected to the liquid inlet portion.

With this application example, the handle portion is supported by the second supporting portion when the liquid outlet portion of the liquid container is connected to the liquid inlet portion, enabling the weight of the liquid containing portion to be taken by the second supporting portion via the handle portion. Accordingly, the load on the liquid outlet portion is suppressed.

Application Example 15

It may be preferable that, in the liquid container, the liquid outlet portion is formed to be oriented in a direction intersecting the direction of gravity when supported by the first supporting portion.

With this application example, the liquid outlet portion is easy to see, and engaging of the engaging portion of the liquid outlet portion with the first supporting portion is facilitated, since the liquid outlet portion faces in a direction intersecting the direction of gravity, when supported by the first supporting portion. Furthermore, in the case where the handle portion is provided, the liquid outlet portion is easy to see even when, for example, the handle portion is being gripped, compared with the case where the liquid outlet portion faces in the direction of gravity, enabling the engaging portion of the liquid outlet portion to be reliably engaged with the first supporting portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments will be described with reference to the drawings, taking a printer serving as one liquid jet apparatus as an example. Note that the scale of constituent elements and members in the individual diagrams may differ, since the respective constituent elements are shown at a size that enables recognition.

Figure 1:
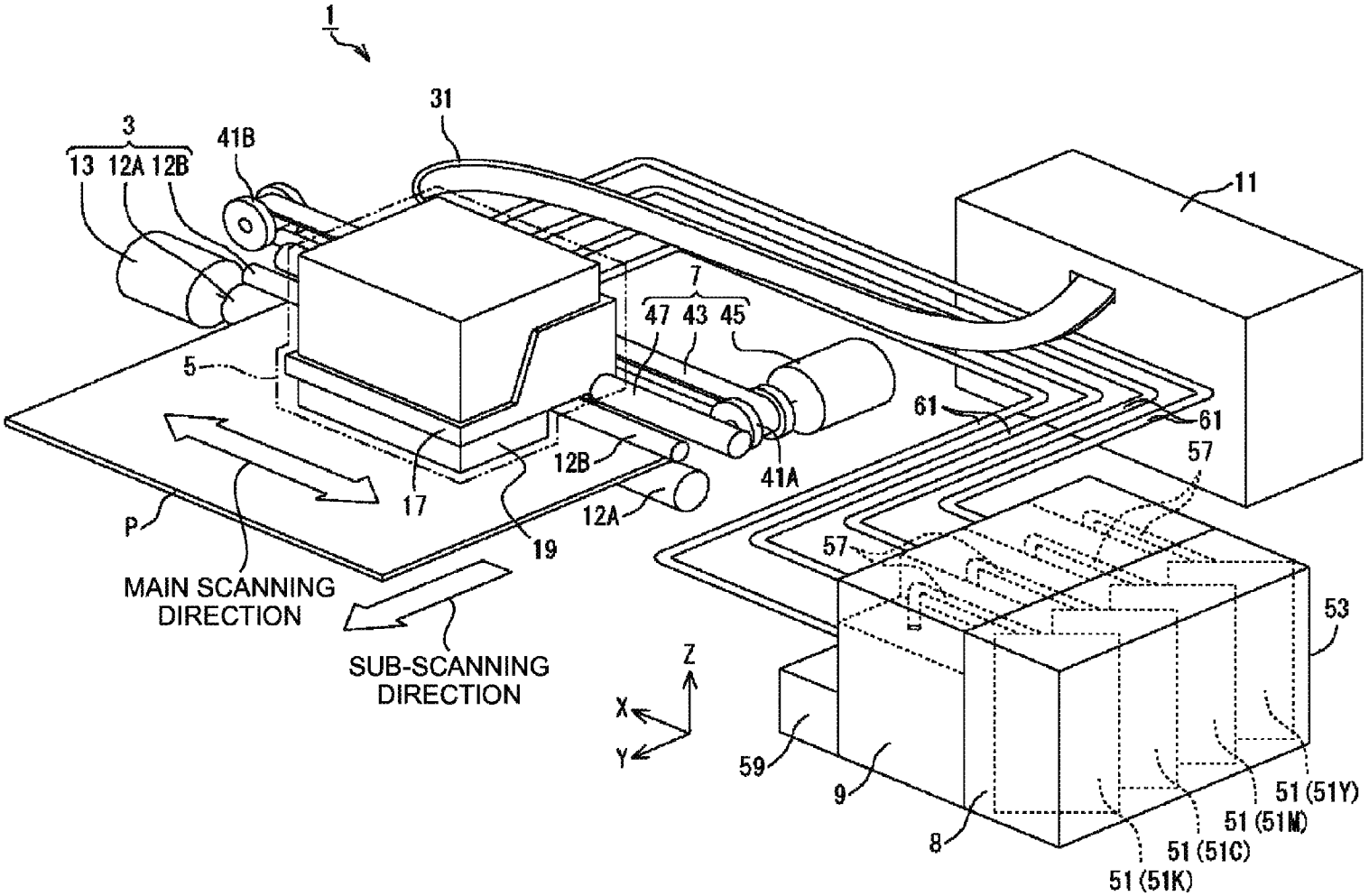
FIG. 1 is a perspective view showing a principal configuration of a printer of an embodiment.

A printer 1 in the present embodiment, as shown in FIG. 1, has a conveyance apparatus 3, a recording part 5, a moving apparatus 7, an ink supply apparatus 8, a relay apparatus 9, and a control part 11. Note that, in FIG. 1, the X-axis, the Y-axis and the Z-axis, which are orthogonal to each other, are illustrated in order to facilitate understanding. The X-axis, Y-axis and Z-axis orthogonal to each other will also be given in diagrams shown below if necessary. The X-axis, the Y-axis and the Z-axis in FIG. 1 correspond respectively to the X-axis, Y-axes and Z-axes in other diagrams.

The conveyance apparatus 3 conveys recording media P such as recording paper intermittently in a sub-scanning direction in the diagram. The recording part 5 records on the recording media P conveyed by the conveyance apparatus 3 with ink serving as an exemplary liquid. The moving apparatus 7 moves the recording part 5 back and forth in a main scanning direction in the diagram. The ink supply apparatus 8 supplies ink to the recording part 5 via the relay apparatus 9. The relay apparatus 9 relays the ink from the ink supply apparatus 8 between the ink supply apparatus 8 and the recording part 5. The control part 11 controls the drive of each of above constituent elements. In the present embodiment, the main scanning direction corresponds in the X-axis direction, and the sub-scanning direction corresponds in the Y-axis direction, when the printer 1 is in a use state.

The conveyance apparatus 3, as shown in FIG. 1, has a driving roller 12A, a driven roller 12B, and a conveyance motor 13. The driving roller 12A and the driven roller 12B are configured to be rotatable with outer circumferences thereof contacting each other. The conveyance motor 13 produces power for rotatably driving the driving roller 12A. The power from the conveyance motor 13 is transmitted to the driving roller 12A via a transmission mechanism. Recording media P held between the driving roller 12A and the driven roller 12B are intermittently conveyed in the sub-scanning direction.

The recording part 5 is provided with a carriage 17 and a recording head 19. The recording head 19 discharges ink as ink droplets and records on the recording media P. The carriage 17 is equipped with the recording head 19. Note that the recording head 19 is connected to the control part 11 via a flexible cable 31. The discharge of ink droplets from the recording head 19 is controlled by the control part 11.

The moving apparatus 7, as shown in FIG. 1, is provided with a timing belt 43, a carriage motor 45, and a guide shaft 47. The timing belt 43 is routed in a tensioned state around a pair of pulleys 41A and 41B. The pair of pulleys 41A and 41B are aligned in the main scanning direction. The timing belt 43 is routed in the main scanning direction. The carriage motor 45 produces power for rotatably driving the pulley 41A. The guide shaft 47 extends in the main scanning direction. The guide shaft 47 is supported at both ends by a casing which is not illustrated, and guides the carriage 17 in the main scanning direction.

Note that, in the present embodiment, the printer 1 is in a use state when placed on a level surface that is defined by the main scanning direction and the sub-scanning direction. The conveyance direction and the main scanning direction are orthogonal to the vertical direction when the printer 1 is the use state. The conveyance direction and the main scanning direction are illustrated as being orthogonal to the Z-axis direction. When the printer 1 is the use state, the Z-axis direction coincides with the vertical direction. Also, when the printer 1 in the use state, an orientation facing the recording media P from the recording head 19, that is, the negative Z-axis direction, is a vertically downward orientation.

The carriage 17 is fixed to a portion of the timing belt 43. Power is transmitted to the carriage 17 from the carriage motor 45 via the pulley 41A and the timing belt 43. Also, the carriage 17 is configured to be moveable back and forth in the main scanning direction by the transmitted power.

The ink supply apparatus 8, as shown in FIG. 1, has an ink container 51 serving as an exemplary liquid container, a case 53, and an attachment/detachment unit 141 which will be discussed later. Note that, in the present embodiment, the ink supply apparatus 8 includes a plurality of (the present embodiment, four) ink containers 51. The four ink containers 51 are held in the case 53. The case 53 is provided with the attachment/detachment unit 141 (discussed later) supporting the ink container 51. The four ink containers 51 are supported so as to be attachable to and detachable from the attachment/detachment unit 141. Each ink container 51 has an ink bag serving as a liquid containing portion. Ink is sealed by the ink bag, which is constituted by a flexible sheet. With the printer 1, the ink container is replaced with a new ink container 51 when the ink in the ink bag has been consumed.

Different types of ink are held in the four ink containers 51. In the present embodiment, yellow (Y) ink, magenta (M) ink, cyan (C) ink and black (K) ink are held in respectively different ink containers 51. Hereinafter, when identifying the four ink containers 51 by the type of ink, the four ink containers 51 will be respectively denoted as ink container 51Y, ink container 51M, ink container 51C and ink container 51K. The ink container 51Y has an ink bag in which yellow ink is sealed. Similarly, the ink container 51M has an ink bag in which magenta ink is sealed, the ink container 51C has an ink bag in which cyan ink is sealed, and the ink container 51K has an ink bag in which black ink is sealed.

An ink supply tube 57 is connected to the ink bag inside each ink container 51 via the attachment/detachment unit 141 discussed later. The ink supply tube 57 serving as an exemplary flow channel member is connected to the relay apparatus 9 from the ink supply apparatus 8. The relay apparatus 9 has a pump unit 59. The pump unit 59 pumps the ink inside the ink containers 51 installed in the ink supply apparatus 8. The pump unit 59 then sends the ink pumped from the ink container 51 to the recording head 19 via the ink supply tube 61. The ink inside the ink container 51 is thereby supplied from the ink supply apparatus 8 to the recording head 19 via the relay apparatus 9. The ink supplied to the recording head 19 is then discharged as ink droplets from nozzles (not shown) that face the recording media P side.

With the printer 1 having the above configuration, the drive of the conveyance motor 13 is controlled by the control part 11, and the conveyance apparatus 3 intermittently conveys the recording media P in the sub-scanning direction while positioning the recording media P so as oppose the recording head 19. At this time, the control part 11 causes ink droplets to be discharged at predetermined positions by controlling the drive of the recording head 19, while moving the carriage 17 back and forth in the main scanning direction by controlling the drive of the carriage motor 45. Such operations result in dots being formed on the recording media P, and recording based on recording information such as image data being performed to the recording media P.

Figure 2:
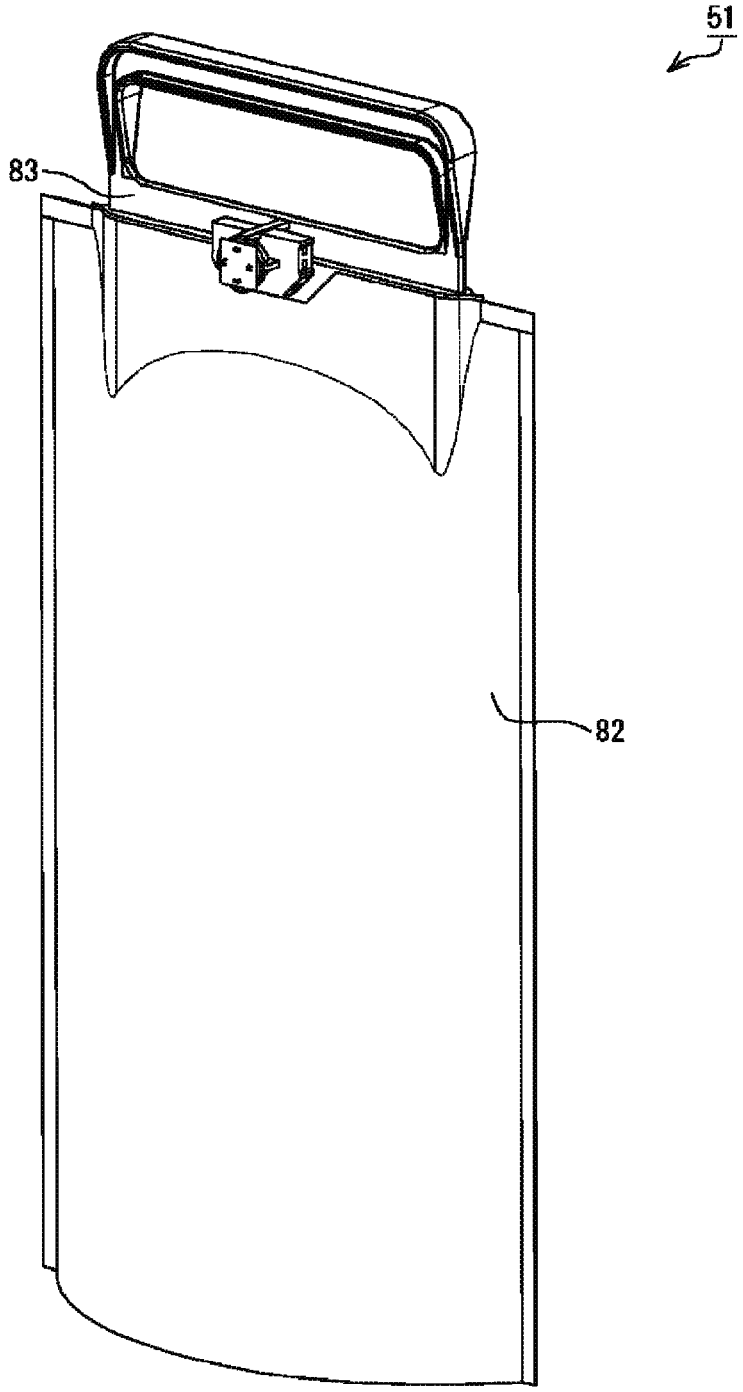
FIG. 2 is a perspective view showing an ink container of the embodiment.
Figure 3:
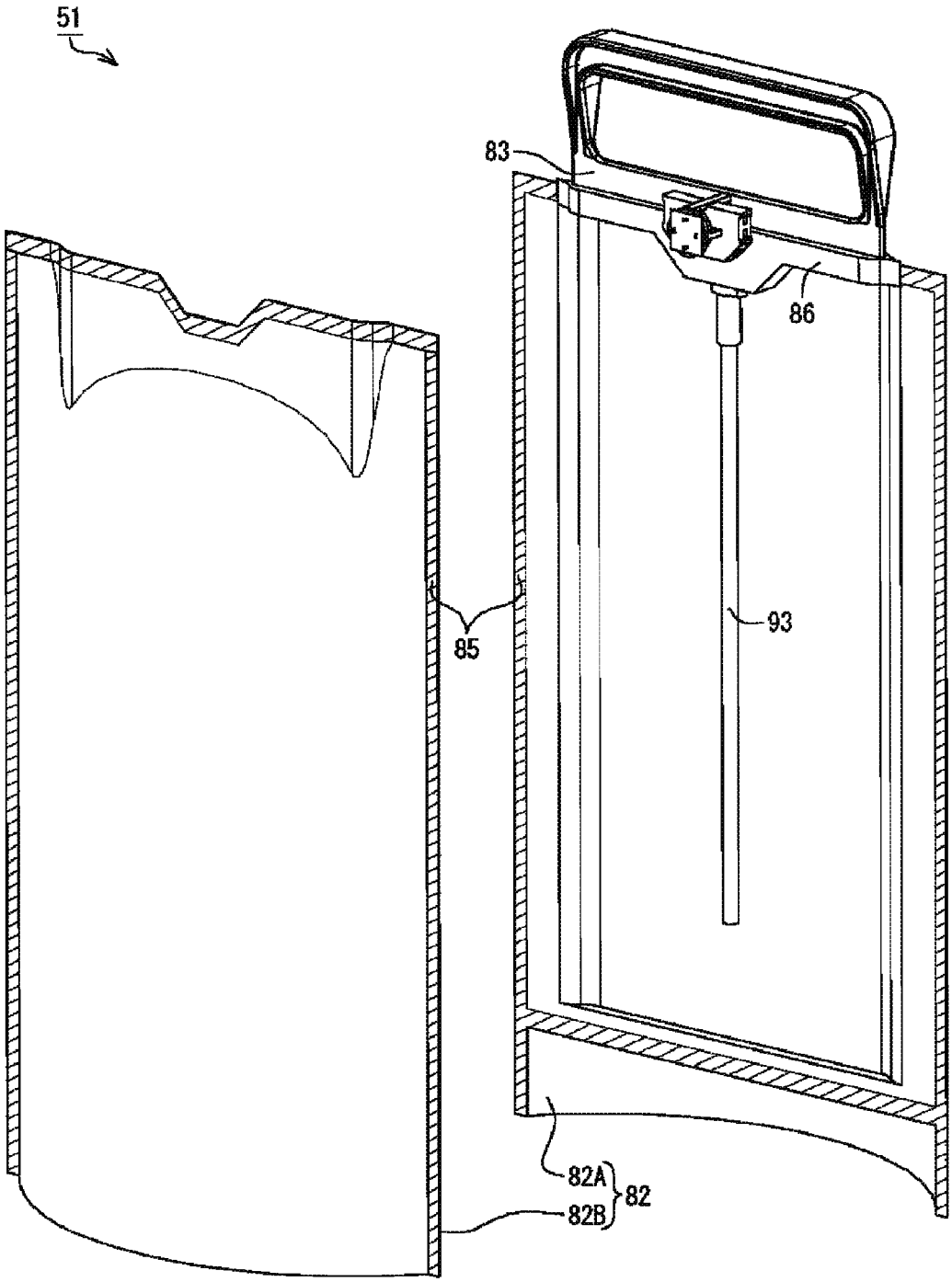
FIG. 3 is an exploded perspective view showing an ink container of the embodiment.

The ink containers 51, as shown in FIG. 2, each have an ink bag 82 serving as an exemplary liquid containing portion and a flow channel unit 83. The ink bag 82, as shown in FIG. 3, has a sheet 82A and a sheet 82B which are flexible sheet members. The sheet 82A and the sheet 82B are laid one on the other and adhered to each other around a peripheral region 85. The ink bag 82 thereby has a bag-like shape and at least a portion of the ink bag is flexible. Ink is held inside the ink bag 82. The ink bag 82 thus functions as an ink containing portion that holds ink serving as an exemplary liquid. Note that, in FIG. 3, the peripheral region 85 is hatched in order to facilitate understanding of the configuration.

Material such as polyethylene terephthalate (PET), nylon and polyethylene can be employed for the sheet 82A and the sheet 82B. A laminated structure obtained by laminating sheets of film constituted by such materials may also be employed. PET or nylon which both have excellent shock resistance can be used for the outer layer of such a laminated structure, and polyethylene which has excellent ink resistance can be used for the inner layer, for example. Furthermore, a film or the like having a layer vapor deposited with aluminum or the like can also be employed. Gas barrier properties are thereby improved.

The flow channel unit 83 is sandwiched by the sheet 82A and the sheet 82B in a portion of the peripheral region 85. The flow channel unit 83 and the sheet 82A are adhered to each other in a portion of the peripheral region 85. Similarly, the flow channel unit 83 and the sheet 82B are adhered to each other in a portion of the peripheral region 85. The portion of the peripheral region 85 where the flow channel unit 83 is sandwiched by the sheet 82A and the sheet 82B is thus where the ink bag 82 joins the flow channel unit 83. An adhering portion 86 is provided in the flow channel unit 83. The sheet 82A and the sheet 82B are both adhered to the adhering portion 86, in a state where the adhering portion 86 is sandwiched by the sheet 82A and the sheet 82B. The ink bag 82 functions as a bag for holding ink by the sheet 82A, the sheet 82B and the flow channel unit 83 being joined to each other.

Figure 4:
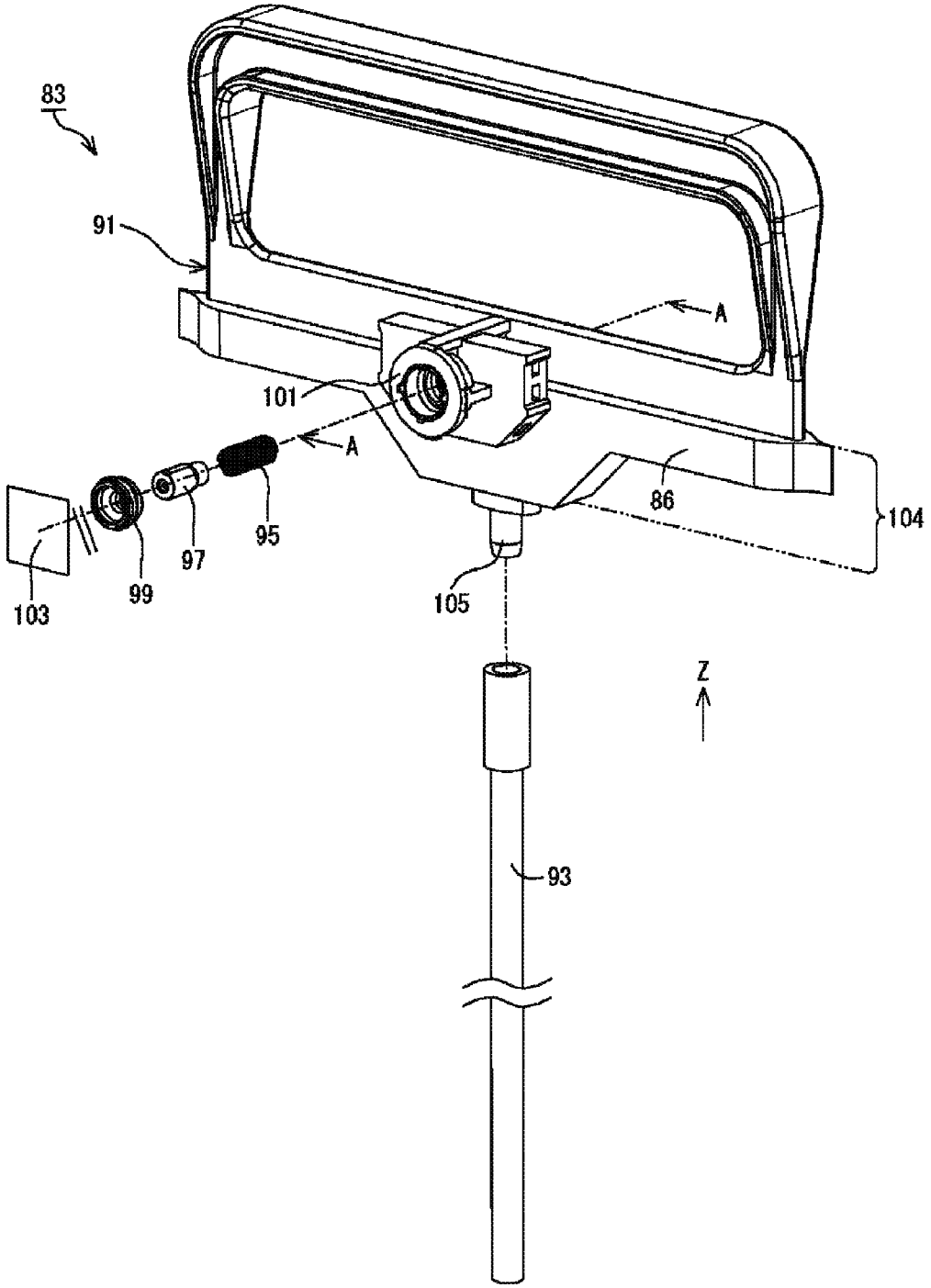
FIG. 4 is an exploded perspective view showing a flow channel unit of the embodiment.

The flow channel unit 83, as shown in FIG. 4, has a flow channel member 91, a tube 93, and a spring 95, a plug (valve body) 97 and packing (valve seat) 99 that constitute a valve. A supply pipe 101 is provided in the flow channel member 91. The inside of the ink bag 82 (FIG. 3) is in communication with the outside via the supply pipe 101. The flow channel member 91 functions as a liquid outlet portion that guides ink serving as an exemplary liquid from the inside of the ink bag 82 to the outside. The spring 95, the plug 97 and the packing 99 are housed in this order inside the supply pipe 101. Prior to the ink container 51 being installed in the ink supply apparatus 8, the supply pipe 101 is closed by a film 103. The inside of the ink bag 82 is thereby maintained in a sealed state.

The flow channel member 91 has a base portion 104. The side surface of the base portion 104 is configured as the adhering portion 86. The flow channel member 91 is provided with an inlet port 105. The inlet port 105 is provided in the base portion 104, and extends in the Z-axis direction. The inlet port 105 projects from the base portion 104 in the negative Z-axis direction. The inlet port 105 is in communication with the inside the ink bag 82, and introduces ink inside the ink bag 82 to the supply pipe 101. Note that the supply pipe 101 extends in a direction intersecting the direction in which the inlet port 105 extends, that is, in a direction intersecting the Z-axis direction. The supply pipe 101 is also provided in the base portion 104, and projects from the base portion 104 in a direction intersecting the Z-axis direction. The tube 93 is connected to the inlet port 105. The tube 93, as shown in FIG. 3, is housed in the ink bag 82. An inlet channel to the inlet port 105 is extended to inside the ink bag 82 by the tube 93.

Figure 5:
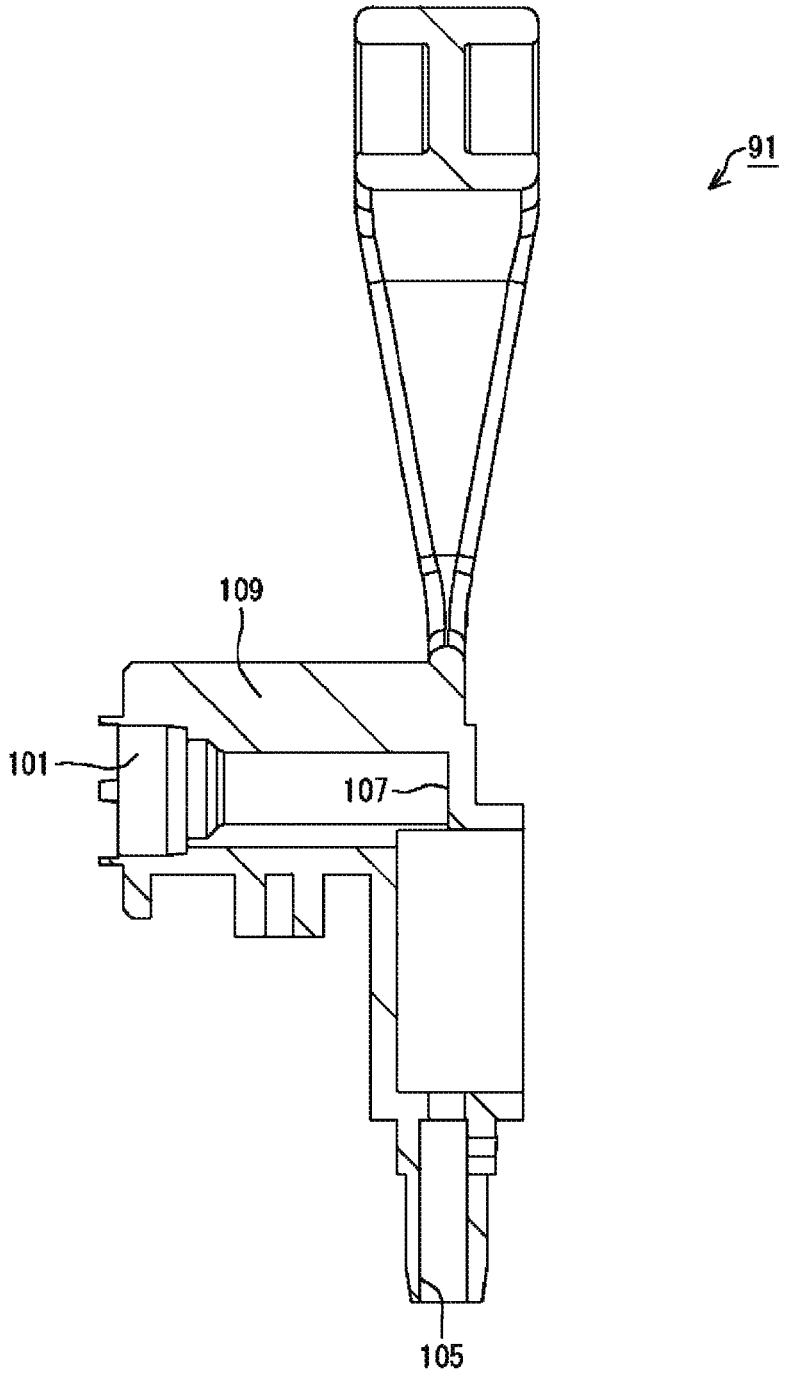
FIG. 5 is a cross-sectional view of the flow channel member of the embodiment sectioned along line A-A in FIG. 4.
Figure 6:
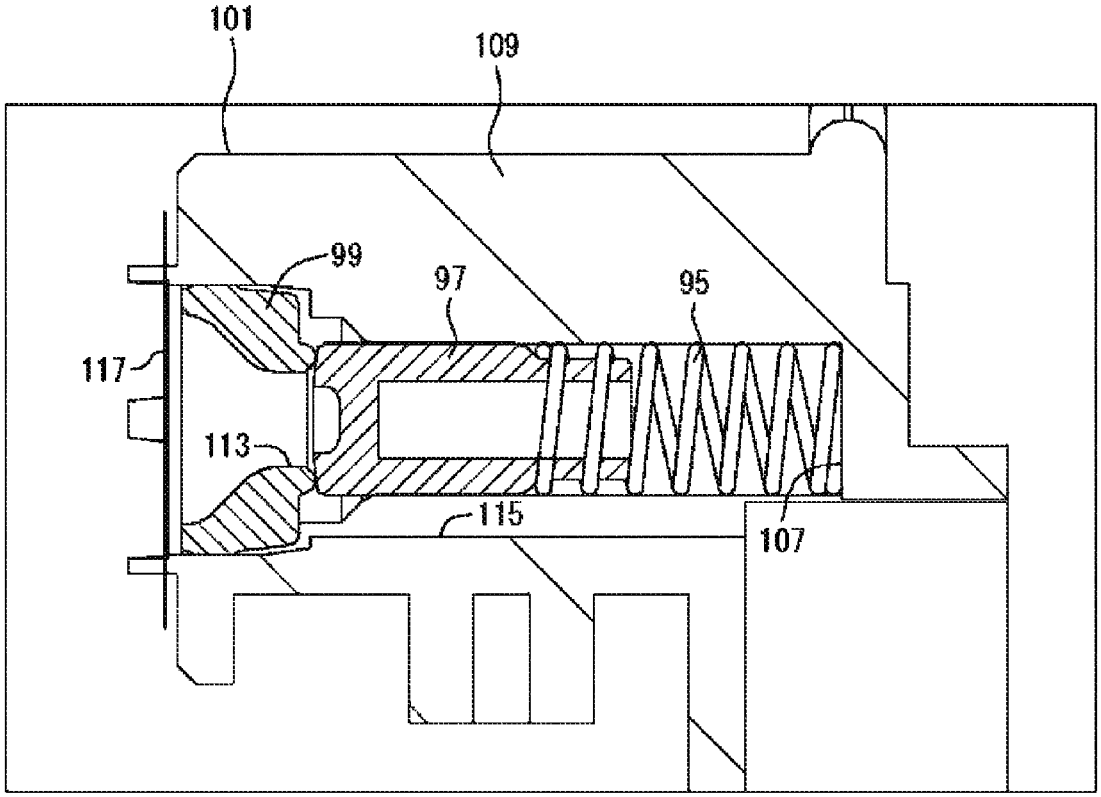
FIG. 6 is an enlarged cross-sectional of the flow channel unit of the embodiment sectioned along line A-A in FIG. 4.

Inside of the flow channel member 91, the supply pipe 101 is in communication with the inlet port 105, as shown in FIG. 5. The supply pipe 101 has a bottom portion 107 and a side wall 109. The side wall 109 surrounds the bottom portion 107. The area surrounded by the side wall 109 functions as a supply port through which ink inside the ink bag 82 is supplied to the outside. The spring 95, the plug 97 and the packing 99 are housed on the inside of the supply pipe 101, as shown in FIG. 6. The spring 95 is sandwiched by the bottom portion 107 of the supply pipe 101 and the plug 97. The plug 97 is sandwiched by the spring 95 and the packing 99. The plug 97 is thus biased toward the packing 99 side by the spring 95.

The packing 99 is constituted by an elastic body such as rubber or an elastomer, for example. The packing 99 is press-fitted into the supply pipe 101. The packing 99 is provided with an opening 113. The plug 97 is biased toward the packing 99 side in a state of overlapping the opening 113 of the packing 99. The opening 113 of the packing 99 is thus closed by the plug 97. A gap is maintained between the plug 97 and the supply pipe 101. A gap is also maintained between the spring 95 and the supply pipe 101. The plug 97 and the spring 95 can thus be displaced inside of the supply pipe 101 in the direction in which the supply pipe 101 extends.

Here, a groove 115 is provided on the inside of the supply pipe 101. The groove 115 extends in the Y-axis direction toward the bottom portion 107 from an end 117 side of the supply pipe 101. The groove 115 reaches further towards the packing 99 side from the bottom portion 107 than the spring 95. The groove 115 is provided so as to be recessed from the inner wall of the supply pipe 101 towards the outer wall. In a state where the plug 97 is housed in the supply pipe 101, the space enclosed by the plug 97 and the groove 115 can be utilized as an ink flow channel.

Figure 7:
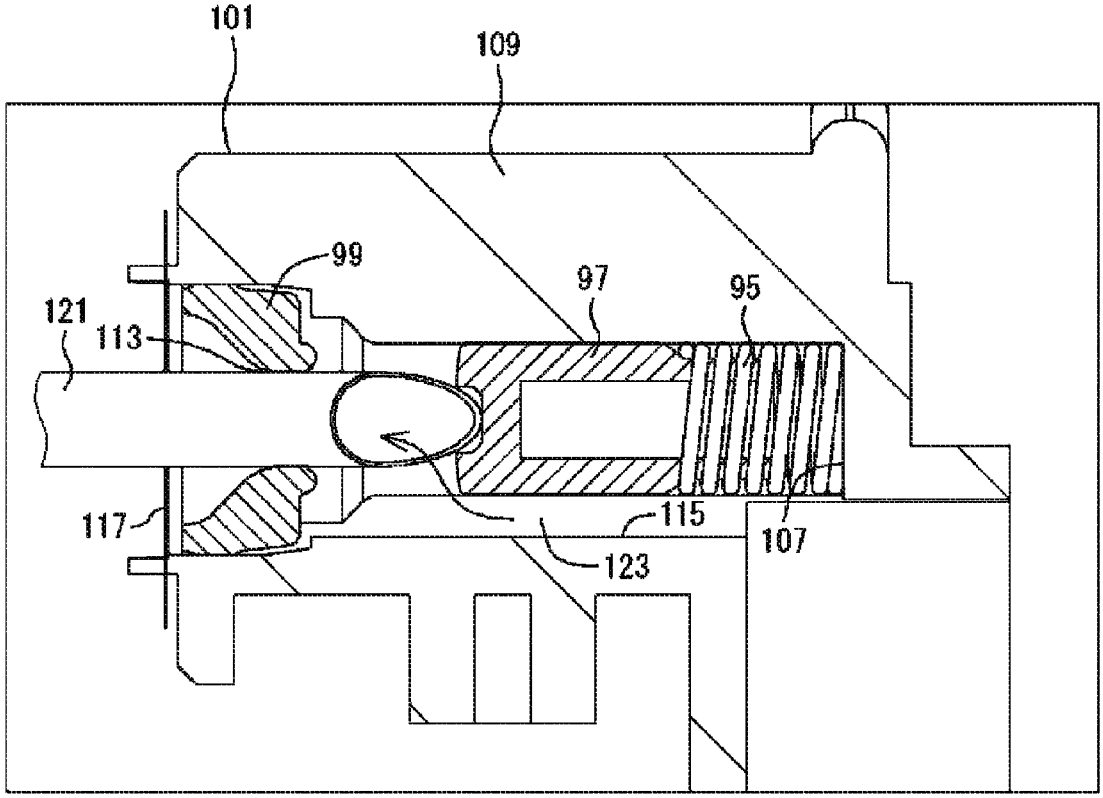
FIG. 7 is an enlarged cross-sectional view of the flow channel unit of the embodiment sectioned along line A-A in FIG. 4.

A supply needle 121 is inserted into the opening 113 of the packing 99, as shown in FIG. 7, when the ink container 51 is installed in the ink supply apparatus 8 (FIG. 1). At this time, the plug 97 is pushed by the supply needle 121 and displaced toward the bottom portion 107 side. The supply needle 121 is hollow. As shown by the arrow in the diagram, ink can thereby be supplied from a flow channel 123 enclosed by the groove 115 and the plug 97 to the ink supply tube 57 (FIG. 1) via the supply needle 121. Note that the supply needle 121 is provided inside the case 53 of the ink supply apparatus 8.

Figure 8:
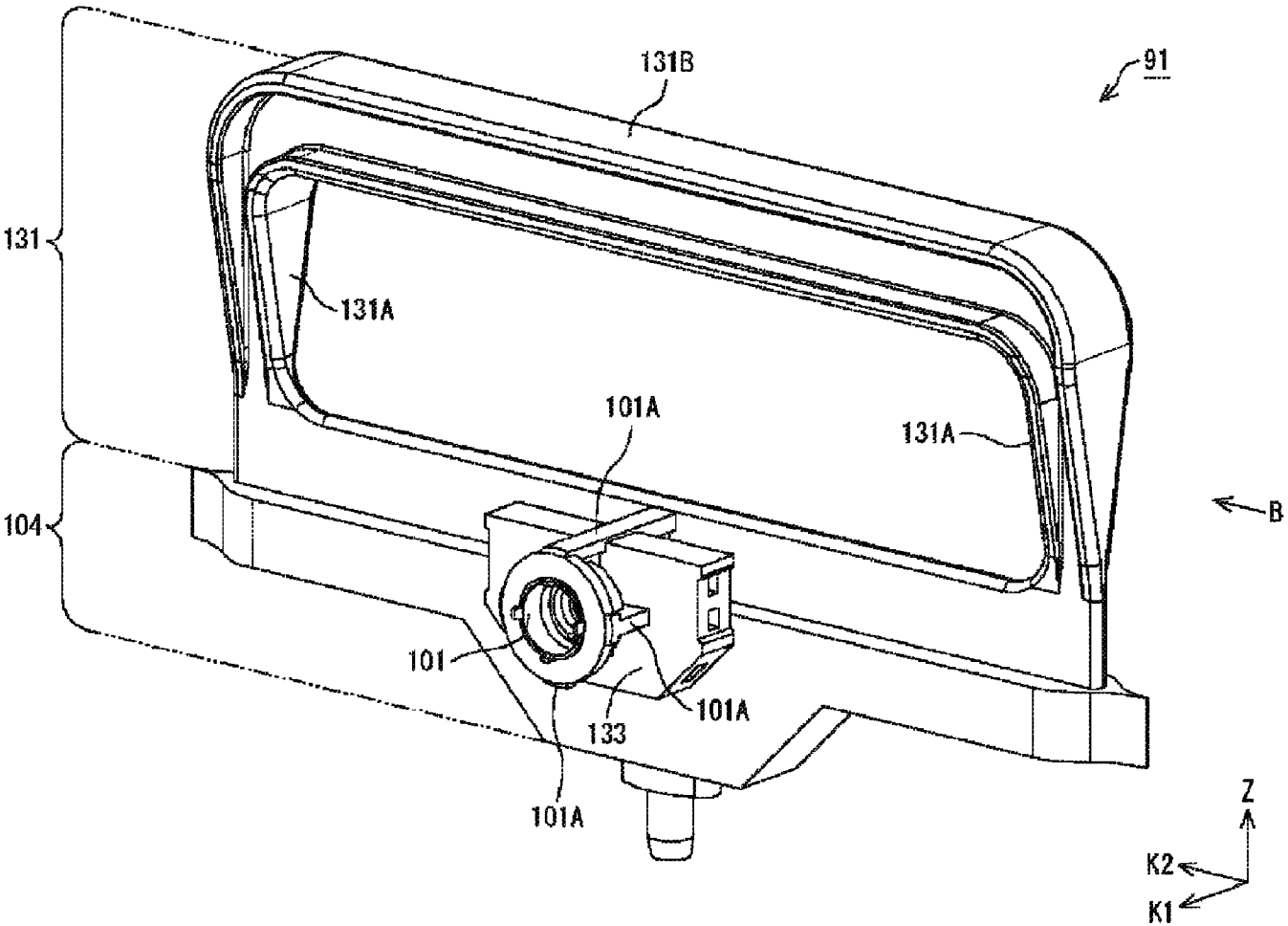
FIG. 8 is a perspective view showing a flow channel member of the embodiment.

The flow channel member 91, as shown in FIG. 8, has a handle portion 131 and an engaging portion 133. The handle portion 131 is provided to the base portion 104. The handle portion 131 projects from the base portion 104 in the positive Z-axis direction, that is, towards the opposite side to the inlet port 105 side of the base portion 104, or in other words, the opposite side to the ink bag 82 side. The handle portion 131 extends in the direction in which the base portion 104 extends. The handle portion 131 has two leg portions 131A and a gripping portion 131B. The two leg portions 131A are both provided to the base portion 104, and extend from the base portion 104 in the positive Z-axis direction. The two leg portions 131A are also referred to as connection portions because of being connected to the base portion 104.

The two leg portions 131A are spaced apart from each other in the direction in which the base portion 104 extends. The gripping portion 131B is provided further in the positive Z-axis direction than the two leg portions 131A, that is, further on the opposite side to the base portion 104 side than the two leg portions 131A. The gripping portion 131B extends in the direction in which the base portion 104 extends. The two leg portions 131A are both connected to the gripping portion 131B. The above configuration enables an operator to insert his or her fingers between the gripping portion 131B and the base portion 104, and grip the gripping portion 131B. The operator is then able to lower the ink container 51 while continuing to grip the gripping portion 131B.

Figure 9:
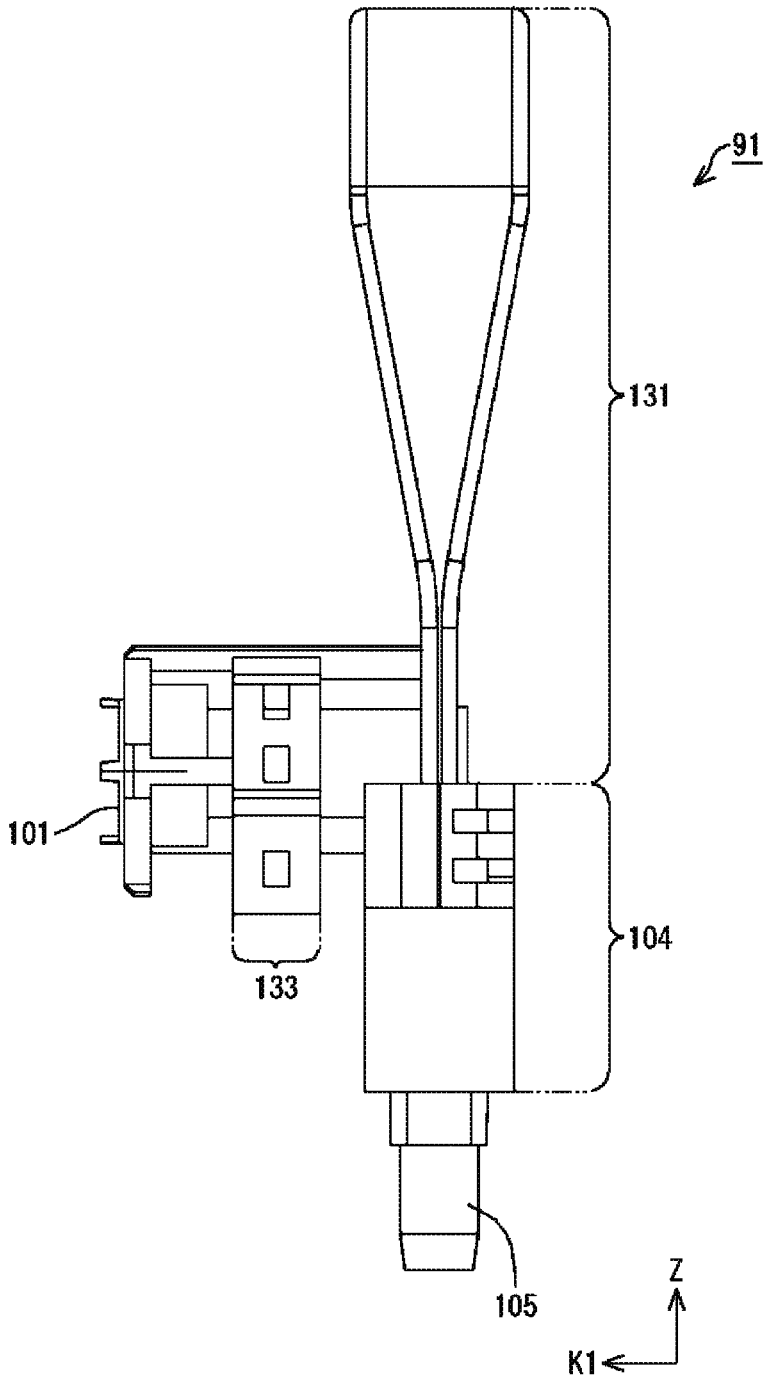
FIG. 9 is a diagram showing the flow channel member of the embodiment as viewed from the direction of B in FIG. 8.

The engaging portion 133 is provided to the supply pipe 101. The engaging portion 133 is board-shaped, and overhangs beyond the supply pipe 101. The engaging portion 133 has the shape of a flange that overhangs beyond the supply pipe 101. The engaging portion 133 is spaced apart from the base portion 104, as shown in FIG. 9, which is a diagram of the flow channel member 91 as viewed from the direction of B in FIG. 8. Here, the supply pipe 101 is provided so as to straddle the base portion 104 and the handle portion 131. Also, the engaging portion 133 is located further on the supply pipe 101 side than the base portion 104 and the handle portion 131. The engaging portion 133 is thus spaced apart from both the base portion 104 and the handle portion 131. The supply pipe 101 projects further on the opposite side to the base portion 104 side than the engaging portion 133. Also, the engaging portion 133 projects further on the inlet port 105 side than the supply pipe 101 in the Z-axis direction. Note that the engaging portion 133 is located further on the base portion 104 side than the inlet port 105 in the Z-axis direction. In the present embodiment, the supply pipe 101, the base portion 104, the inlet port 105, the handle portion 131, and the engaging portion 133 are integrally formed with each other. In the present embodiment, the flow channel member 91 is formed by resin injection molding. The supply pipe 101 extends in a direction intersecting the axial direction of the inlet port 105.

Figure 10:
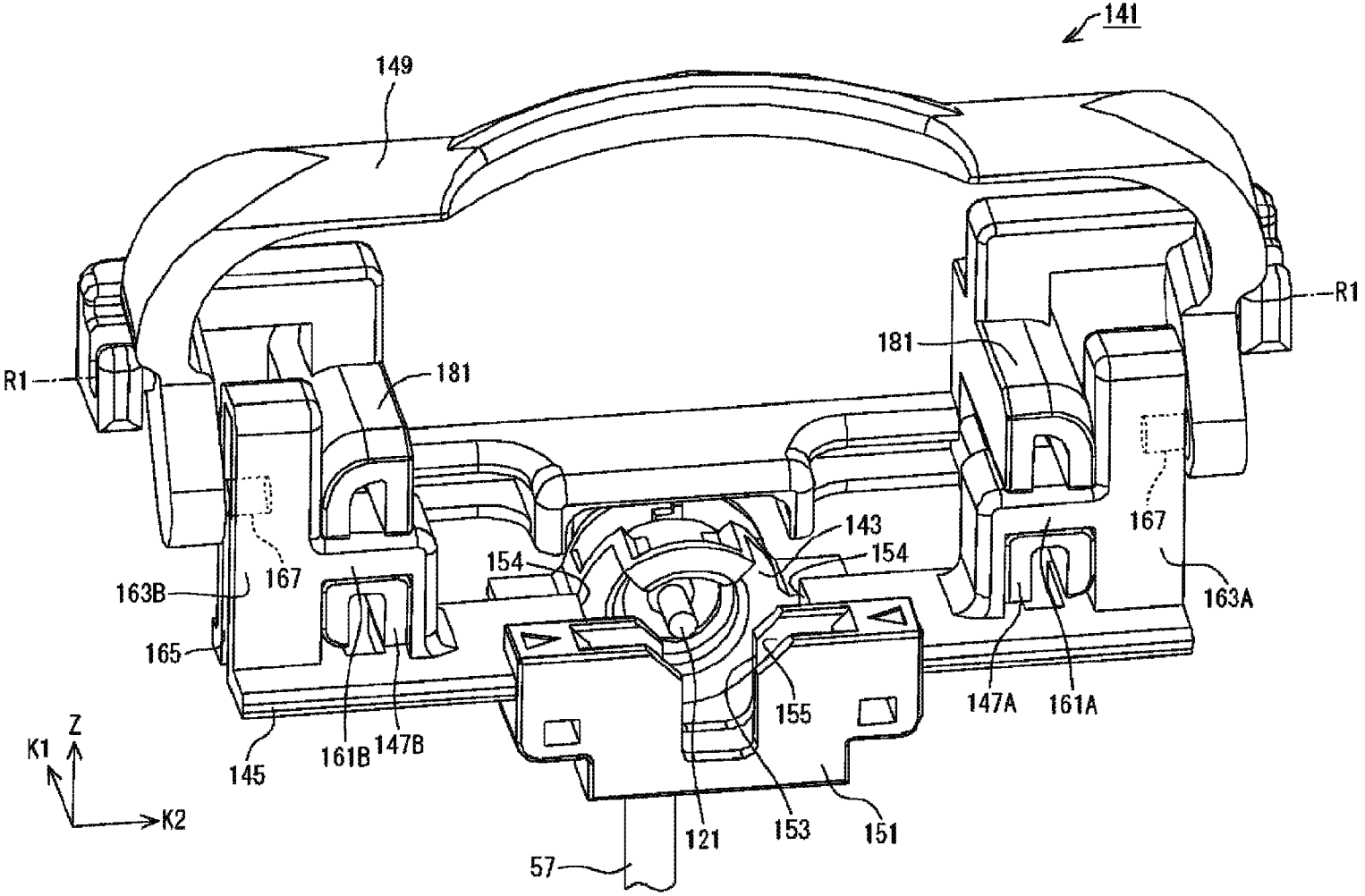
FIG. 10 is a perspective view showing an attachment/detachment unit of the embodiment.

The ink supply apparatus 8 has a plurality of attachment/detachment units 141. The attachment/detachment units 141 include a mechanism for detaching and attaching the ink containers 51 to and from the ink supply apparatus 8. The number of attachment/detachment units 141 provided in the ink supply apparatus 8 is the same as the number of ink containers 51 that can be installed in the ink supply apparatus 8. In other words, an attachment/detachment unit 141 is provided for every ink container 51 that is to be installed in the ink supply apparatus 8. The attachment/detachment unit 141, as shown in FIG. 10, has an ink inlet portion 143, a movable member 145, a guiding portion 147A, a guiding portion 147B, and a lever 149.

The ink inlet portion 143 has the aforementioned supply needle 121. The ink inlet portion 143 functions as a liquid inlet portion through which ink guided from the ink bag 82 of the ink container 51 via the supply pipe 101 is introduced to the relay apparatus 9. The supply needle 121 is in communication with the ink supply tube 57. Here, the direction in which the supply needle 121 extends in the ink supply apparatus 8 is given as a K1 direction. The Z-axis direction in the ink supply apparatus 8 is the same as in the printer 1. The direction that is orthogonal to both the K1 direction and the Z-axis direction is given as a K2 direction. According to these definitions, the supply pipe 101 and the base 104 of the flow channel member 91 in the ink container 51, as shown in FIG. 8, respectively extend in the K1 direction and the K2 direction in the ink supply apparatus 8. Similarly, the gripping portion 131B extends in the K2 direction.

The movable member 145 is configured to be movable back and forth in the K1 direction. The movable member 145 is provided in a position overlapping the ink inlet portion 143, and spans an area straddling the ink inlet portion 143 in the K2 direction, when the attachment/detachment unit 141 is viewed in the K1 direction. The movable member 145 is provided with a first supporting portion 151. The first supporting portion 151 is provided in a position overlapping the ink inlet portion 143, when the attachment/detachment unit 141 is viewed in the K1 direction. The first supporting portion 151 is provided with a cutaway portion 153 at a site overlapping the supply needle 121. Also, the movable member 145 is provided with a cutaway portion 154 at a site overlapping the ink inlet portion 143, when the attachment/detachment unit 141 is viewed in the K1 direction. Thus, when the movable member 145 is moved in the K1 direction towards the ink inlet portion 143, the ink inlet portion 143 can be inserted into the cutaway of the movable member 145, and the supply needle 121 can be inserted into the cutaway portion 153 of the first supporting portion 151.

The first supporting portion 151 is provided with a recessed portion 155. In the first supporting portion 151, the recessed portion 155 is provided so as to be recessed in the negative Z-axis direction. The recessed portion 155 is provided to span an area straddling the cutaway portion 153 in the K2 direction. Thus, when the movable member 145 is moved in the K1 direction towards the ink inlet portion 143, the supply needle 121 can advance into the recessed portion 155 of the first supporting portion 151 via the cutaway portion 153.

Also, a sliding portion 161A, a sliding portion 161B, an interlocked portion 163A and an interlocked portion 163B are provided to the movable member 145. The sliding portion 161A, the sliding portion 161B, the interlocked portion 163A and the interlocked portion 163B respectively project in the positive Z-axis direction from the movable member 145. The sliding portion 161A and the sliding portion 161B are provided in positions facing each other across the supply needle 121 in the K2 direction, when the attachment/detachment unit 141 is viewed in the K1 direction. In the present embodiment, the sliding portion 161A and the sliding portion 161B are respectively provided further to the outside than the first supporting portion 151, when the attachment/detachment unit 141 is viewed in the K1 direction. The sliding portion 161A and the sliding portion 161B are respectively constituted as through holes that pass through in the K1 direction.

The interlocked portion 163A and the interlocked portion 163B are provided in positions facing each other across the supply needle 121 in the K2 direction, when the attachment/detachment unit 141 is viewed in the K1 direction. In the present embodiment, the interlocked portion 163A is provided further on the opposite side to the supply needle 121 side than the sliding portion 161A, when the attachment/detachment unit 141 is viewed in the K1 direction. Also, the interlocked portion 163B is provided further on the opposite side to the supply needle 121 side than the sliding portion 161B, when the attachment/detachment unit 141 is viewed in the K1 direction. A groove 165 that extends in the Z-axis direction is respectively provided in the interlocked portion 163A and the interlocked portion 163B. An interlocked shaft 167 provided on the lever 149 is inserted into each groove 165.

The guiding portion 147A and the guiding portion 147B respectively extend in the K1 direction. The guiding portion 147A overlaps an area surrounded by the sliding portion 161A, when the attachment/detachment unit 141 is viewed in the K1 direction. The guiding portion 147B overlaps an area surrounded by the sliding portion 161B, when the attachment/detachment unit 141 is viewed in the K1 direction. The guiding portion 147A is inserted into the area surrounded by the sliding portion 161A. Also, the guiding portion 147B is inserted into the area surrounded by the sliding portion 161B.

The lever 149 is configured to be turnable about a rotation axis R1. When the lever 149 turns, the two interlocked shafts 167 move in tandem with the turning of the lever 149. In other words, when the lever 149 turns, the two interlocked shafts 167 also turn. As aforementioned, the two interlocked shafts 167 are inserted into the respective grooves 165 of the interlocked portion 163A and the interlocked portion 163B. Thus, when the two interlocked shafts 167 turn, power from the two interlocked shafts 167 is transmitted to the interlocked portion 163A and the interlocked portion 163B. At this time, the sliding portion 161A and the sliding portion 161B are respectively guided by the guiding portion 147A and guiding portion 147B in the K1 direction. The movable member 145 thereby moves in the K1 direction when the lever 149 turns. The lever 149 thus functions as an operation portion for moving the first supporting portion 151.

Here, a state, in the attachment/detachment unit 141, where the ink inlet portion 143 is positioned further to the outside than the cutaway portion 154 of the movable member 145 in the K1 direction, as shown in FIG. 10, is called a disconnected state. The position of the movable member 145 in the disconnected state is called a disconnected position. Note that, in the disconnected state, the supply pipe 101 and the supply needle 121 are not connected. The disconnected state is a state where installation of the ink container 51 in the attachment/detachment unit 141 is released. The disconnected state thus is also called a release state, and the disconnected position is also called a release position.

Figure 11:
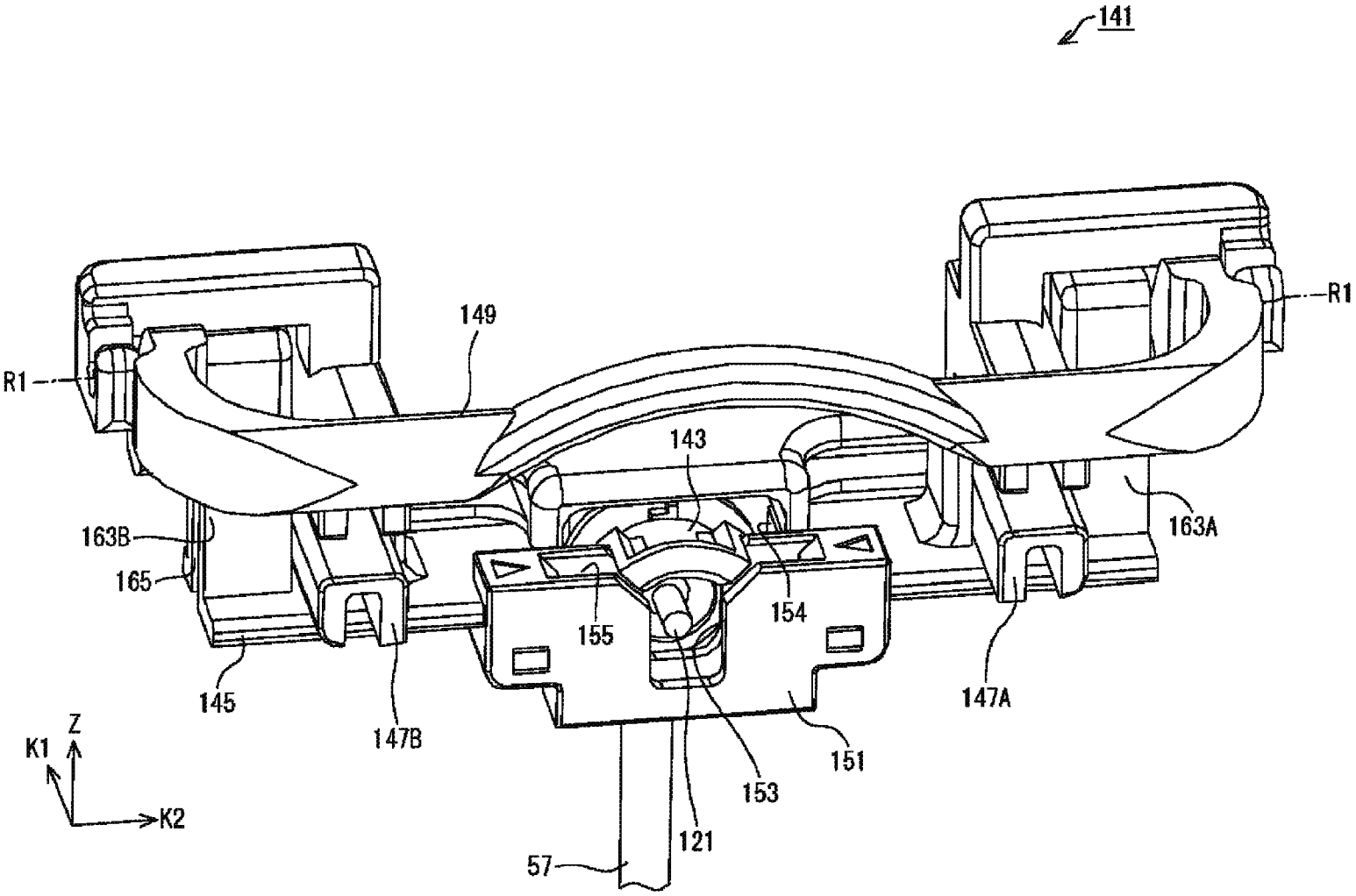
FIG. 11 is a perspective view showing the attachment/detachment unit of the embodiment.

In the present embodiment, there is a gap between the first supporting portion 151 and the supply needle 121 in the disconnected state. In contrast, a state where the ink inlet portion 143 has advanced into the cutaway portion 154 of the movable member 145 in the K1 direction, as shown in FIG. 11, is called a connected state. The position of the movable member 145 in the connected state is called a connected position. Note that the connected state is a state where the supply pipe 101 is connected to the supply needle 121. In the present embodiment, the supply needle 121 has advanced into the recessed portion 155 of the first supporting portion 151 in the connected state.

Figure 12:
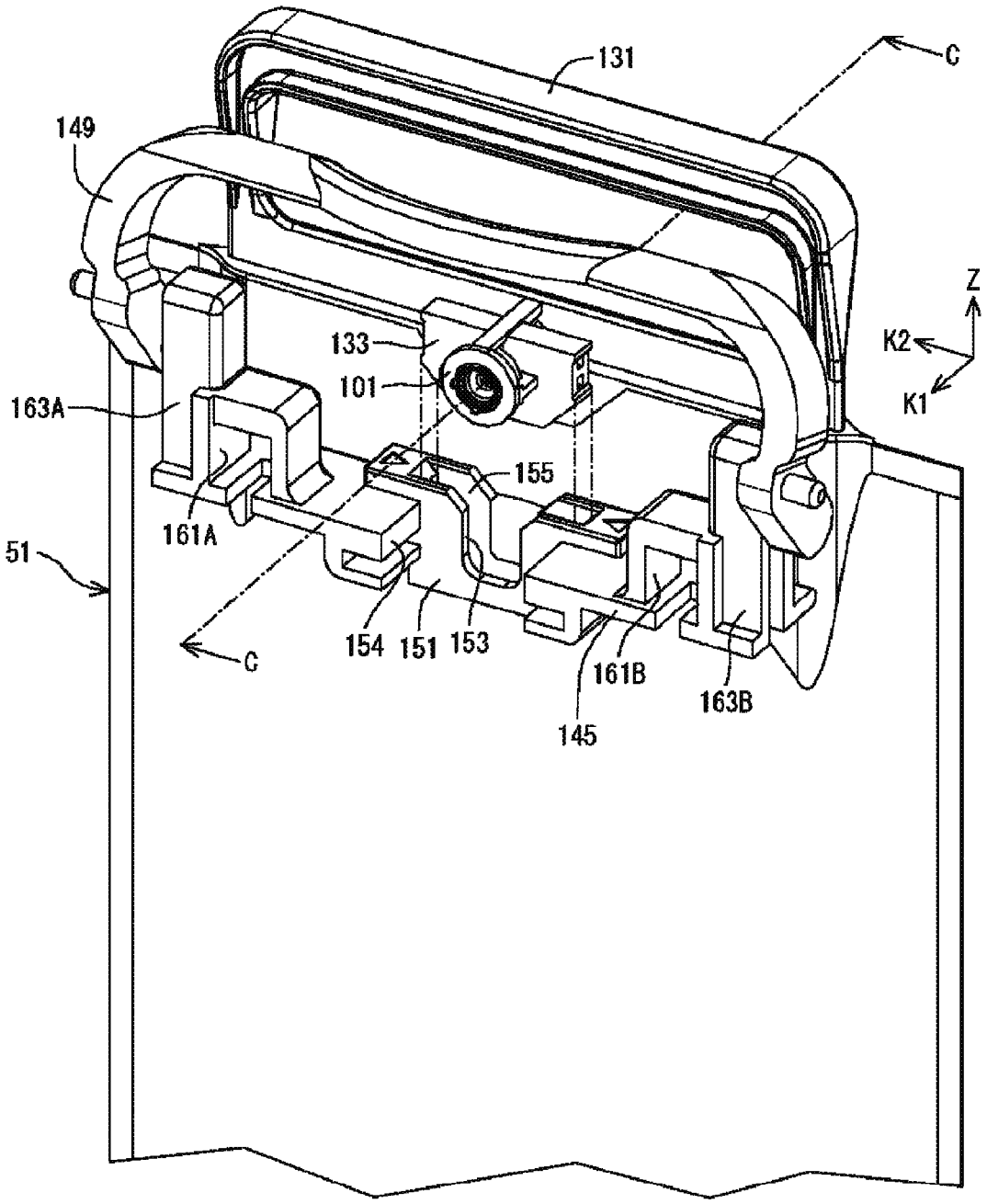
FIG. 12 is a perspective view showing the ink container, a movable member and a lever of the embodiment.
Figure 13:
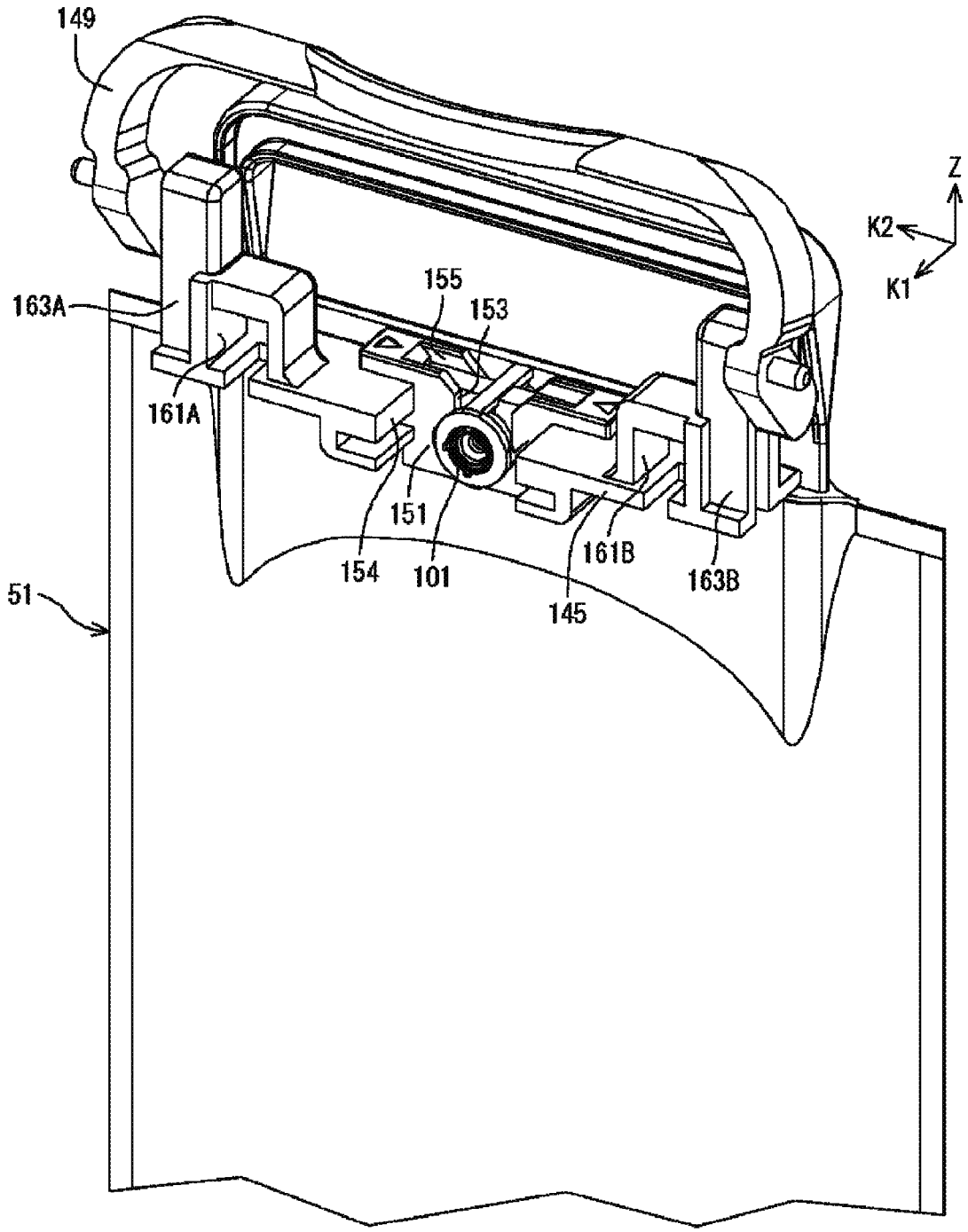
FIG. 13 is a perspective view showing the ink container, the movable member and the lever of the embodiment.

Here, the engaging portion 133 of the ink container 51 is set to a size that is engageable with the recessed portion 155 in the first supporting portion 151 of the movable member 145, as shown in FIG. 12. The engaging portion 133 is thus configured to be insertable into the recessed portion 155 from further on the lever 149 side than the recessed portion 155 in the Z-axis direction. In a state where the engaging portion 133 is inserted into the recessed portion 155, the supply pipe 101 projects to the outside of the recessed portion 155 from the cutaway portion 153 of the first supporting portion 151, as shown in FIG. 13.

Figure 14:
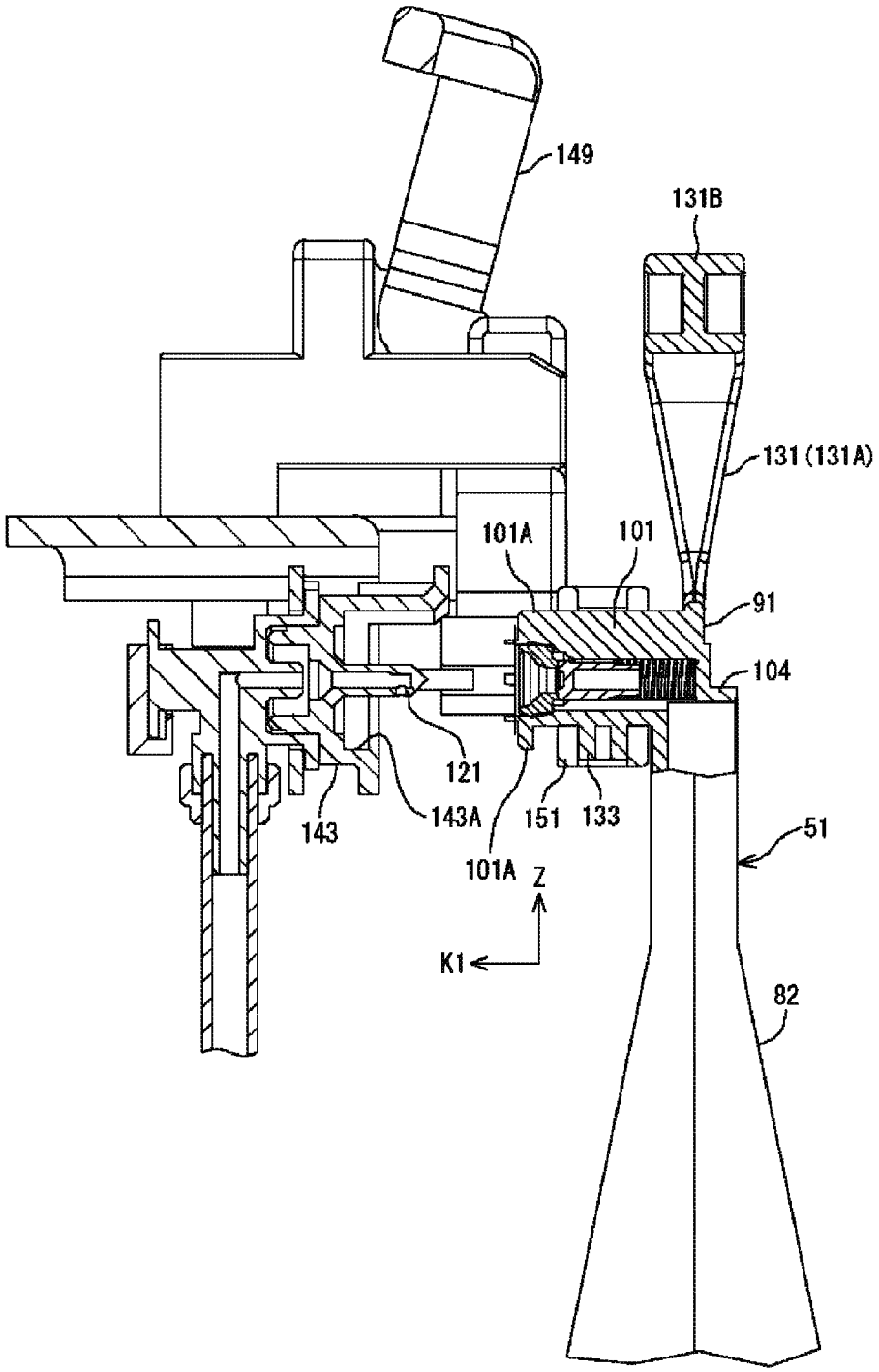
FIG. 14 is a cross-sectional view of the ink container and attachment/detachment unit of the embodiment sectioned along line C-C in FIG. 12.

When installing an ink container 51 in the attachment/detachment unit 141, the operator first grips the gripping portion 131B of the ink container 51 and holds the ink container 51 so as to hang down. Next, the operator engages (inserts) the engaging portion 133 of the ink container 51 with the recessed portion 155 of the attachment/detachment unit 141 in the disconnected state, as shown in FIG. 14. Once the operator has engaged the engaging portion 133 with the recessed portion 155 and let go of the handle portion 131, the ink container 51 will be in a suspended state as a result of the engaging portion 133 being supported by the first supporting portion 151. In this state, the supply needle 121 of the ink inlet portion 143 is spaced apart from the supply pipe 101 because of the attachment/detachment unit 141 being in the disconnected state. Note that while an ink inlet hole in the supply needle 121 is provided in the side surface of the needle, a state where the supply pipe 101 is closed by the plug 97 and the supply needle 121 is not in communication with the ink flow channel inside the supply pipe 101 is also regarded as a disconnected state, even when the supply needle 121 is not spaced apart from the supply pipe 101 and the tip of the needle is positioned inside the supply pipe 101.

Next, when the operator turns the lever 149, the ink inlet portion 143 approaches the first supporting portion 151 in the K1 direction. At this time, the ink container 51 approaches the ink inlet portion 143 as a result. Here, the supply pipe 101, as shown in FIG. 8, is provided with a plurality of ribs 101A. The ribs 101A are provided on the outer circumference of the supply pipe 101, and extend in the direction in which the supply pipe 101 extends, that is, in the K1 direction. Also, the ink inlet portion 143, as shown in FIG. 14, has a cylindrical portion 143A that is cylindrical in shape and surrounds the supply needle 121 on the outside of the supply needle 121. The cylindrical portion 143A and the supply pipe 101 are configured such that the outer circumference of the supply pipe 101 that includes the plurality of ribs 101A is insertable into the cylindrical portion 143A.

Figure 15:
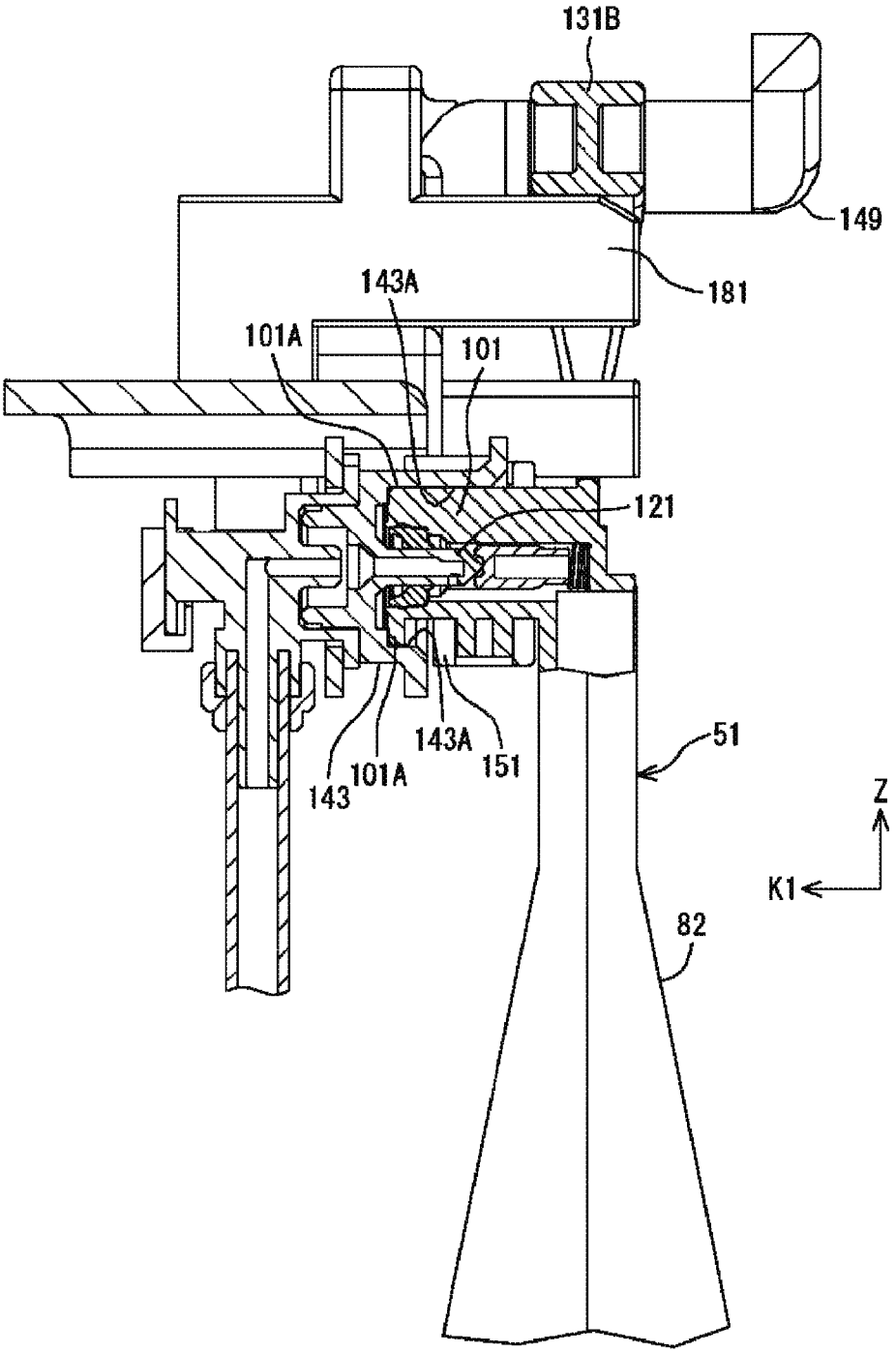
FIG. 15 is a cross-sectional view of the ink container and attachment/detachment unit of the embodiment sectioned along line C-C in FIG. 12.

When the operator turns the lever 149, the supply pipe 101 is inserted into the cylindrical portion 143A, as shown in FIG. 15. The attachment/detachment unit 141 is thereby in the connected state, with the supply needle 121 inserted into the supply pipe 101, and the ink inlet portion 143 (liquid inlet portion) is connected to the supply pipe 101 of the flow channel member 91 (liquid outlet portion). Note that, in the present embodiment, the position of the flow channel member 91 relative to the ink inlet portion 143 is regulated by the fit between the outer circumferential surface of the plurality of ribs 101A of the supply pipe 101 and the inner circumferential surface of the cylindrical portion 143A. Installation of the ink container 51 in the ink supply apparatus 8 is completed when the connected state is achieved. The connected state is a state where the inside of the ink bag 82 and the ink supply tube 57 are connected to each other via the supply needle 121, that is, a state where the inside of the ink bag 82 and the ink supply tube 57 are in communication with each other.

Note that, in the present embodiment, the gripping portion 131B of the handle portion 131 is supported by a second supporting portion 181 in the connected state. Here, the second supporting portion 181, as shown in FIG. 10, is provided in the attachment/detachment unit 141. The second supporting portion 181 is provided in a position opposing the guiding portion 147A across the sliding portion 161A, and in a position opposing the guiding portion 147B across the sliding portion 161B. A state where the engaging portion 133 is supported by the first supporting portion 151 is released in a state where the gripping portion 131B is supported by the second supporting portion 181. In other words, in a state where the gripping portion 131B is supported by the second supporting portion 181, the engaging portion 133 will be free of the first supporting portion 151. Thus, in a state where the gripping portion 131B is supported by the second supporting portion 181, the load on the supply pipe 101 is reduced compared with the load in the disconnected state.

In the attachment/detachment unit 141, when removing the ink container 51, the operator first moves the movable member 145 in the K1 direction by turning the lever 149, away from the ink inlet portion 143. The attachment/detachment unit 141 will thereby be in the disconnected state (FIG. 14). The operator then pulls the engaging portion 133 of the ink container 51 out from the first supporting portion 151, by gripping the handle portion 131 of the ink container 51. The engagement between the engaging portion 133 and the first supporting portion 151 is released, and the ink container 51 can be removed from the attachment/detachment unit 141.

In the present embodiment, the ink container 51 can be detached and attached in the ink supply apparatus 8, by turning the lever 149 in a state where the first supporting portion 151 supports the ink container 51. Also, in the ink supply apparatus 8, the supply pipe 101 can be connected to the ink inlet portion 143, or the connection between the supply pipe 101 and the ink inlet portion 143 can be released, by turning the lever 149 in a state where the first supporting portion 151 is supporting the ink container 51. In this way, in the ink supply apparatus 8, attachment and detachment of the ink container 51 and connection and disconnection of the supply pipe 101 and the ink inlet portion 143 can be performed together by turning the lever 149. The ink container 51 in the ink supply apparatus 8 can thus be easily replaced.

Also, in the present embodiment, the handle portion 131 of the ink container 51 is provided higher up than the supply pipe 101 in the Z-axis direction. Furthermore, in the ink container 51, the supply pipe 101 is provided on the handle portion 131 side with respect to the ink bag 82. Thus, by gripping the handle portion 131, the ink container 51 can be held such that the supply pipe 101 is positioned higher up than the ink bag 82. Ink is thereby unlikely to leak from the supply pipe 101. Also, being able to hold the handle portion 131 facilitates carrying of the ink container 51. Moreover, by holding the handle portion 131, as compared with holding the flexible ink bag 82, damaging the ink bag 82 is easily avoided.

Also, in the present embodiment, the handle portion 131 and the supply pipe 101 are integrally formed with each other, allowing the number of components constituting the ink container 51 to be reduced. The manufacturing processes of the ink container 51 can also be reduced.

Also, in the present embodiment, the gripping portion 131B of the handle portion 131 is thicker than portions located on the base portion 104 side as shown in FIG. 14. Gripping the gripping portion 131B of the handle portion 131 is thus facilitated.

Also, in the present embodiment, the engaging portion 133 is provided in the supply pipe 101, allowing the supply pipe 101 is be easily attached to the ink inlet portion 143 by engaging the engaging portion 133 with the first supporting portion 151.

Also, in the present embodiment, the supply pipe 101 is oriented in a direction intersecting the Z-axis direction, which is the direction of gravity, in a state where the first supporting portion 151 is supporting the engaging portion 133. The supply pipe 101 is thus easy to see, enabling support by the first supporting portion 151 to be reliably implemented. Thus, the ink container 51 is prevented from falling when the first supporting portion 151 moves, and attachment and detachment of the supply pipe 101 to and from the ink inlet portion 143 can be favorably performed.

Also, in the present embodiment, the supply pipe 101 is oriented in a direction intersecting the direction of gravity, in a state where the handle portion 131 is supported. Here, when the supply pipe 101 is oriented in the direction of gravity, the supply pipe 101 is difficult to see in a state where the handle portion 131 is being gripped, for example, because the supply pipe 101 tends to be hidden by the handle portion 131. In contrast, in the present embodiment, the supply pipe 101 is oriented in a direction intersecting the direction of gravity, making it unlikely that the supply pipe 101 will be hidden by the handle portion 131 when the handle portion 131 is being gripped, for example. The supply pipe 101 is thus easy to see.

What is claimed is:

1. A liquid supply apparatus having detachably installed therein, a liquid container including a liquid containing portion that is flexible at least in part and a liquid outlet portion that is in fluid communication with the liquid containing portion, and adapted to supply a liquid from the liquid containing portion to a liquid supply apparatus, the liquid supply apparatus comprising:

a liquid inlet portion of the liquid supply apparatus, configured to be connected to the liquid outlet portion of the liquid container, and adapted to introduce the liquid from the liquid outlet portion in a state where the liquid container is in the installed condition and the liquid outlet portion is connected to the liquid inlet portion; and a first supporting portion of the liquid supply apparatus, configured to engage the liquid container in the installed condition and support at least the liquid outlet portion of the liquid container, wherein when the liquid container is in the installed condition, the first supporting portion is moveable, between at least a connected position wherein the liquid outlet portion is connected to the liquid inlet portion and a disconnected position, wherein the liquid outlet portion is not connected to the liquid inlet portion.

2. The liquid supply apparatus according to claim 1, further comprising an operation portion configured to move the first supporting portion between at least the connected position and the disconnected position by operating the operation portion.

3. The liquid supply apparatus according to claim 1, wherein the liquid container has a handle portion, having no liquid passing therethrough, that projects from the liquid outlet portion in an opposite direction and on an opposite side from the liquid containing portion side with respect to the liquid outlet portion.

4. The liquid supply apparatus according to claim 3, further comprising a second supporting portion of the liquid supply apparatus, configured to support the handle portion of the liquid container, when the liquid outlet portion of the liquid container is connected to the liquid inlet portion.

5. The liquid supply apparatus according to claim 3, wherein the handle portion and the liquid outlet portion are integrally formed.

6. The liquid supply apparatus according to claim 3, wherein the handle portion has a connection portion connected to the liquid outlet portion and a gripping portion provided at a site that is projected further on an opposite side to the liquid containing portion side than the connection portion, and in the handle portion, the gripping portion is thicker than the connection portion and an open space is provided through which a user's hand can be placed when holding the gripping portion.

7. The liquid supply apparatus according to claim 3, wherein the handle portion includes a gripping portion and a connection portion connected to the gripping portion, the connection portion being provided further on the opposite side of the liquid containing portion than is the liquid outlet portion, and the gripping portion provided further on the opposite side of the liquid containing portion than is the connection portion.

8. The liquid supply apparatus according to claim 1, wherein the liquid outlet portion includes an engaging portion configured to engage the first supporting portion.

9. The liquid supply apparatus according to claim 1, wherein the liquid outlet portion is oriented in a direction intersecting the direction of gravity when supported by the first supporting portion.

10. A liquid container configured to hold a liquid and supply the liquid to a liquid jet apparatus, the liquid container comprising:

a liquid containing portion that is flexible at least in part, and configured to hold the liquid internally;

a liquid outlet portion provided at a first end portion of the liquid containing portion, and configured to connect with a liquid inlet portion of the liquid jet apparatus when the liquid container is engaged with the liquid jet apparatus and introduce the liquid from the liquid containing portion to outside of the liquid containing portion;

a handle portion at the first end portion of the liquid containing portion, the handle portion projecting from the liquid outlet portion in a direction opposite to the liquid containing portion side with respect to the liquid outlet portion and the handle portion having no liquid flowing therethrough, wherein the handle portion includes a gripping portion and a connection portion connected to the gripping portion, the connection portion being provided further on the opposite side of the liquid containing portion than is the liquid outlet portion, and the gripping portion provided further on the opposite side of the liquid containing portion than is the connection portion.

11. The liquid container according to claim 10, wherein the handle portion and the liquid outlet portion are integrally formed.

12. The liquid container according to claim 10, wherein the handle portion has a connection portion connected to the liquid outlet portion and a gripping portion provided at a site that is projected on an opposite side to the liquid containing portion with respect to the connection portion, and in the handle portion, the gripping portion is thicker than the connection portion.

13. The liquid container combination according to claim 10, wherein the handle projects in a Z-axis direction and has an open space through which a user can place their hand while holding the handle and the liquid outlet portion is oriented in a direction intersecting the Z-axis direction.

14. The liquid container combination according to claim 10, wherein the liquid outlet portion includes a supply pipe and an inlet port in fluid communication with the interior of the ink containing portion; and wherein the inlet port extends in a Z-axis direction and the supply pipe extends in a direction intersecting the Z-axis direction.

15. A combination liquid container configured to be detachably installed in a liquid supply apparatus that supplies a liquid to a liquid jet apparatus and a first supporting portion of a liquid supply apparatus, the liquid container and first supporting portion combination comprising:

a liquid containing portion of the liquid container that is flexible at least in part, and configured to hold the liquid internally, supported by the first supporting portion;

a liquid outlet portion provided at a first end portion of the liquid containing portion, and configured to introduce the liquid in the liquid containing portion to outside of the liquid containing portion, wherein the liquid outlet portion includes an engaging portion at the first end portion of the liquid containing portion, configured to engage the first supporting portion to support the liquid container, the first supporting portion being moveable between at least a connected position of the liquid outlet portion and the liquid inlet portion and a disconnected position of the liquid outlet portion and the liquid inlet portion.

16. The liquid container combination according to claim 15, further comprising a handle portion at the first end portion of the liquid containing portion that projects on an opposite side to the liquid containing portion side with respect to the liquid outlet portion.

17. The liquid container combination according to claim 16, further comprising a second supporting portion and the handle portion is supported by the second supporting portion, when the liquid outlet portion is connected to the liquid inlet portion.

18. The liquid container combination according to claim 15, wherein the liquid outlet portion is formed to be oriented in a direction intersecting the direction of gravity when supported by the first supporting portion.

* * * * *